US005950057A

United States Patent [19]

Erhardt et al.

[11] Patent Number: 5,950,057

[45] Date of Patent: Sep. 7, 1999

[54] HYBRID SCAVENGELESS DEVELOPMENT USING ION CHARGING

[75] Inventors: Peter F. Erhardt, Webster; Eugene F. Young, Rochester, both of N.Y.

[73] Assignee: Xerox Corporation, Stamford, Conn.

[21] Appl. No.: 09/087,948

[22] Filed: Jun. 1, 1998

[51] Int. Cl.[6] ..... G03G 15/08

[52] U.S. Cl. ..... 399/266; 399/291

[58] Field of Search ..... 399/266, 289–291, 399/319

[56] References Cited

U.S. PATENT DOCUMENTS 3,697,169 10/1972 Maksymiak et al. ..... 399/284

5,128,723 7/1992 Bolte et al. ..... 399/266

*Primary Examiner*—William Royer

*Assistant Examiner*—William A Noe

*Attorney, Agent, or Firm*—Lloyd F. Bean II

[57] ABSTRACT

An apparatus and method for enhancing toner charge level in a hybrid scavengeless development system. The system includes a housing defining a chamber storing a supply of developer material including toner; a toner donor member spaced from the surface and being adapted to transport toner to a region opposed from the surface; A mag roll conveys the developer material in the chamber of the housing onto a region of the donor member; A charging device ion charges the toner loaded on the region of the donor member; and an electrode member space near the surface of the donor member being electrically biased by a power supply to detach toner from the donor member as to form a toner cloud for developing the latent image.

4 Claims, 4 Drawing Sheets

HYBRID SCAVENGELESS DEVELOPMENT USING ION CHARGING

BACKGROUND OF THE PRESENT INVENTION

This invention relates generally to a development apparatus for ionographic or electrophotographic imaging and printing apparatuses and machines, and more particularly is directed to an apparatus and method for enhancing toner charge level in a hybrid scavengeless development system.

Generally, the process of electrophotographic printing includes charging a photoconductive member to a substantially uniform potential so as to sensitize the surface thereof. The charged portion of the photoconductive surface is exposed to a light image from either a scanning laser beam or an original document being reproduced. This records an electrostatic latent image on the photoconductive surface. After the electrostatic latent image is recorded on the photoconductive surface, the latent image is developed. Two component and single component developer materials are commonly used for development. A typical two component developer comprises magnetic carrier granules having toner particles adhering triboelectrically thereto. A single component developer material typically comprises toner particles. Toner particles are attracted to the latent image forming a toner powder image on the photoconductive surface, the toner powder image is subsequently transferred to a copy sheet, and finally, the toner powder image is heated to permanently fuse it to the copy sheet in image configuration.

The electrophotographic marking process given above can be modified to produce color images. One color electrophotographic marking process, called image on image processing, superimposes toner powder images of different color toners onto the photoreceptor prior to the transfer of the composite toner powder image onto the substrate. While image on image process is beneficial, it has several problems. For example, when recharging the photoreceptor in preparation for creating another color toner powder image it is important to level the voltages between the previously toned and the untoned areas of the photoreceptor.

Moreover, the viability of printing system concepts such as image on image processing usually requires development systems that do not scavenge or interact with a previously toned image. Since several known development systems, such as conventional magnetic brush development and jumping single component development, interact with the image receiver, a previously toned image will be scavenged by subsequent development, and as these development systems are highly interactive with the image bearing member, there is a need for scavengeless or noninteractive development systems.

Single component development systems use a donor roll for transporting charged toner to the development nip defined by the donor roll and photoconductive member. The toner is developed on the latent image recorded on the photoconductive member by a combination of mechanical and/or electrical forces. Scavengeless development and jumping development are two types of single component development systems that can be selected. In one version of a scavengeless development system, a plurality of electrode wires are closely spaced from the toned donor roll in the development zone. An AC voltage is applied to the wires to generate a toner cloud in the development zone. The electrostatic fields associated with the latent image attract toner from the toner cloud to develop the latent image. In another version of scavengeless development, interdigitated electrodes are provided within the surface of a donor roll. The application of an AC bias between the adjacent electrodes in the development zone causes the generation of a toner cloud. In jumping development, voltages are applied between a donor roll and the substrate of the photoreceptor member. In one version, only a DC voltage is applied to the donor roll to prevent toner deposition in the nonimage areas. In the image areas, the electric field from the closely spaced photoreceptor attracts toner from the donor. In another version, an AC voltage is superimposed on the DC voltage for detaching toner from the donor roll and projecting the toner toward the photoconductive member so that the electrostatic fields associated with the latent image attract the toner to develop the latent image.

A problem encountered with single component and hybrid development systems is low toner charge on the donor roll. Normal means to enhance charge in hybrid development systems is to change the toner/carrier formulations. In some cases this is not sufficient to ensure adequate toner charge on the donor roll. High triboelectric charge is necessary to overcome fringe field effects at latent image boundaries in the noninteractive image-on-image development systems. Attempts to enhance the charge via changes in the toner and carrier formulation have proven to be unsuccessful.

Briefly, the present invention obviates the problems noted above by providing an apparatus and method for enhancing toner charge level in a hybrid scavengeless development system. The system includes a housing defining a chamber storing a supply of developer material comprising toner; a toner donor member spaced from the surface and being adapted to transport toner to a region opposed from the surface; means for conveying said developer material in the chamber of said housing onto a region of said donor member; means for ion charging said toner loaded on the region of said donor member; and an electrode member space near the surface of said donor member, said electrode member being electrically biased by a power supply to detach toner from said donor member as to form a toner cloud for developing the latent image.

Inasmuch as the art of electrophotographic printing is well known, the various processing stations employed in the printing machine will be shown hereinafter schematically and their operation described briefly with reference thereto.

DETAILED DESCRIPTION OF THE PRESENT INVENTION

Figure 1:
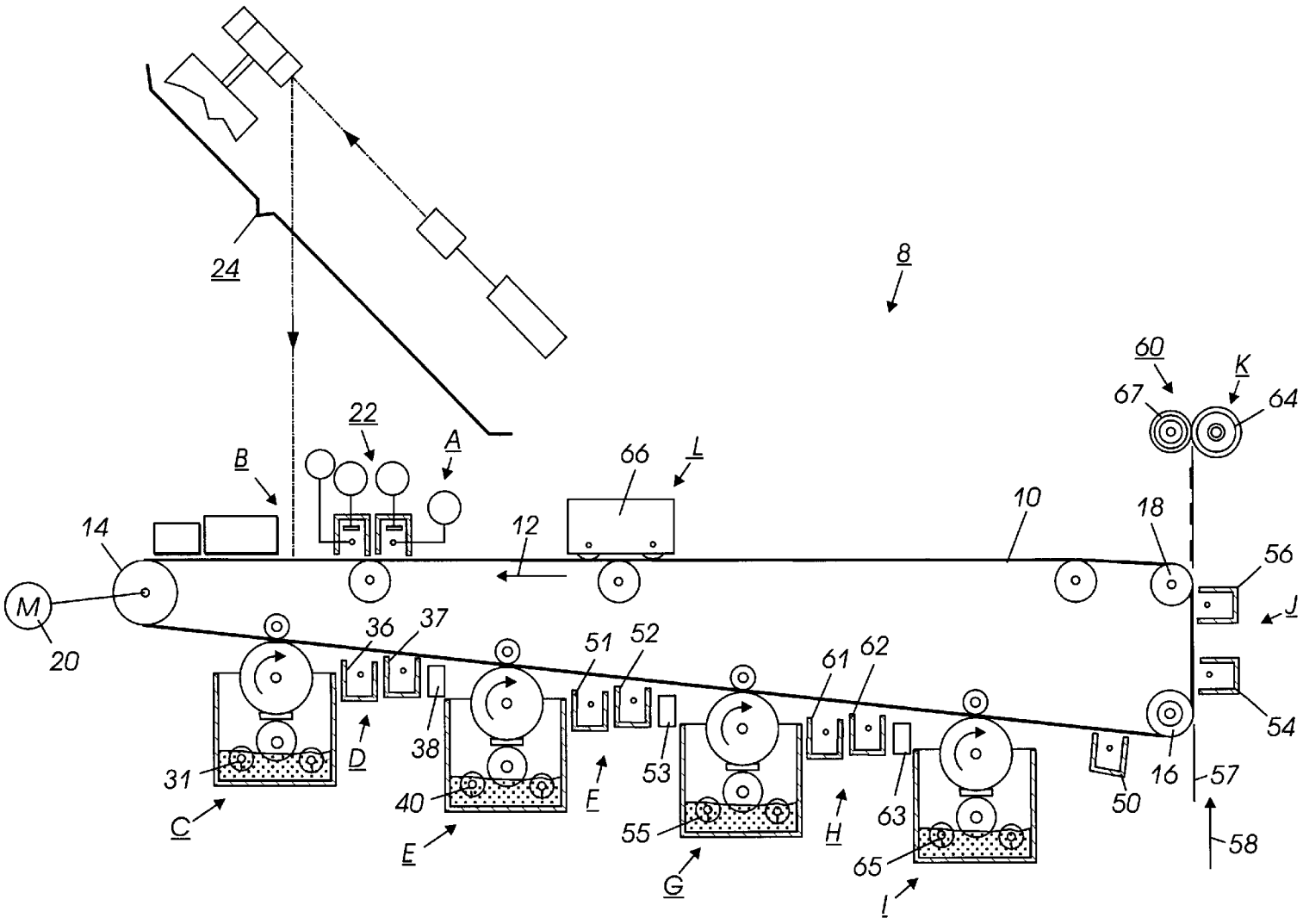
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2:
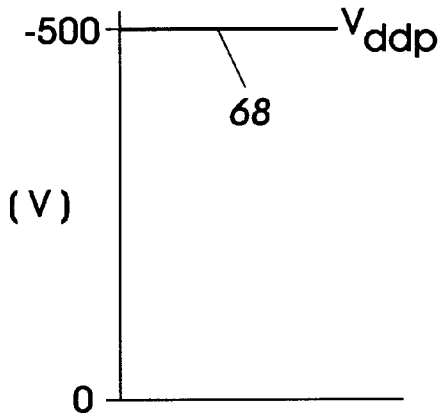
FIG. 2 shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2 illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2 shows the image area as being negatively charged, it could be positively charged if the charge levels and polarities of the toners, recharging devices, photoreceptor, and other relevant regions or devices are appropriately changed.

Figure 3:
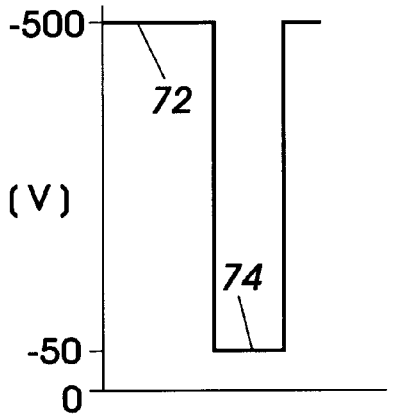
FIG. 3 shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 3 shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits negatively charged toner 31 of a first color (say black) onto the image area. That toner is attracted to the less negative sections of the image area and repelled by the more negative sections. The result is a first toner powder image on the image area.

Figure 8:
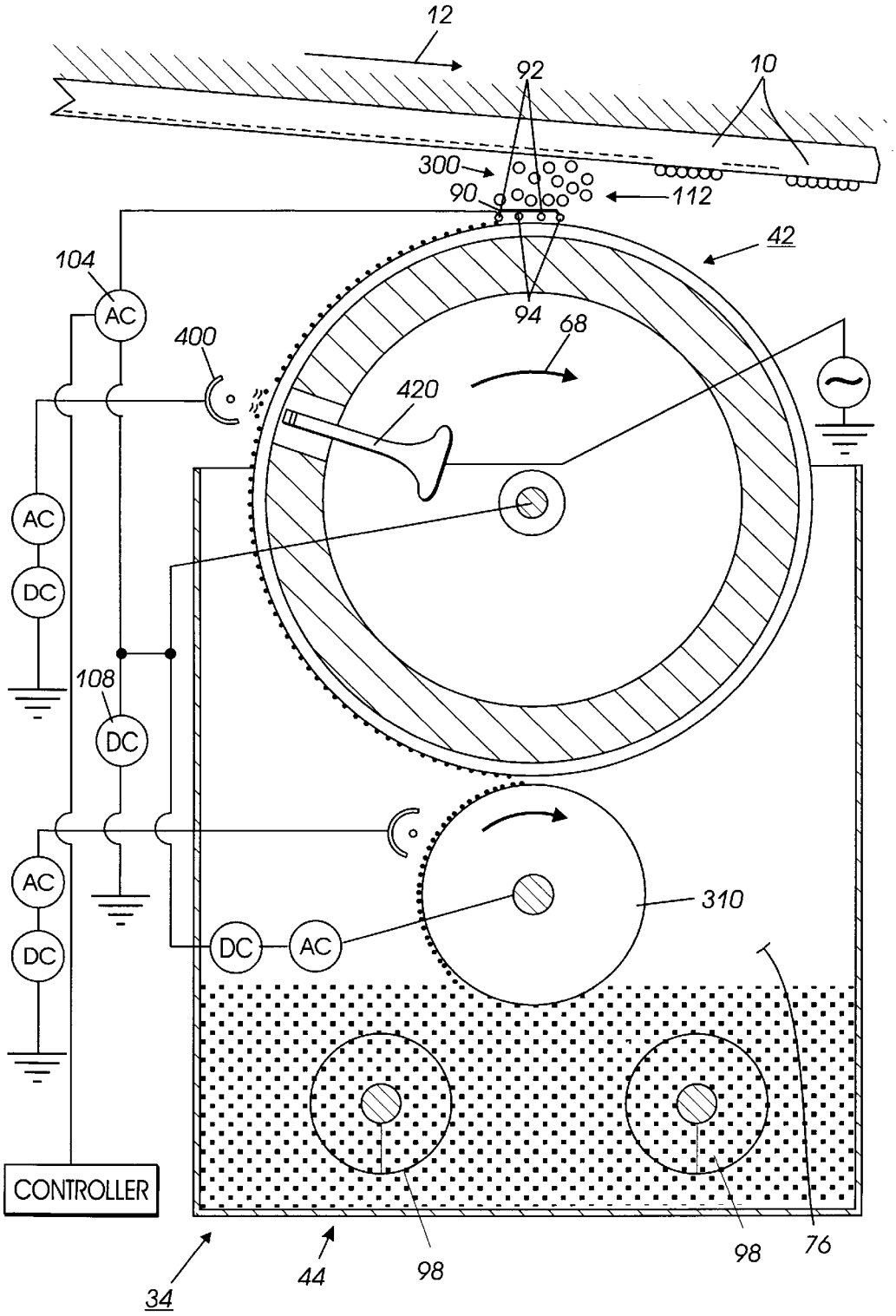
FIG. 8 is a schematic elevational view showing the development apparatus used in the FIG. 1 printing machine.

For the first development station C, development system 34 includes a donor roll 42. As illustrated in FIG. 8, electrode grid 90 is electrically biased with an AC voltage relative to donor roll 42 for the purpose of detaching toner therefrom so as to form a toner powder cloud 112 in the gap between the donor roll and photoconductive surface. Both electrode grid 90 and donor roll are biased at a DC potential 108 for discharge area development (DAD). The discharged photoreceptor image attracts toner particles from the toner powder cloud to form a toner powder image thereon.

Figure 4:
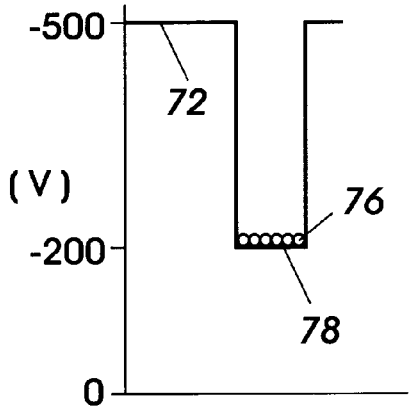
FIG. 4 shows a typical voltage profile of the image area after being developed.

FIG. 4 shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level −500 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 5:
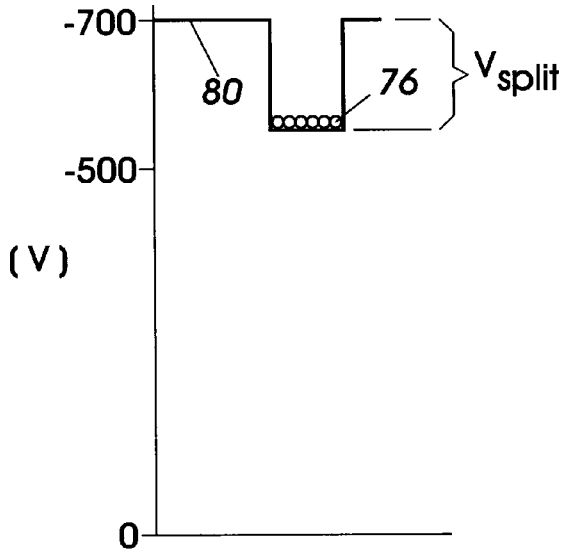
FIG. 5 shows a typical voltage profile of the image area after being recharged by a first recharging device.

FIG. 5 shows the voltages on the image area after it passes through the first recharging device 36. The first recharging device overcharges the image area to more negative levels than that which the image area is to have when it leaves the recharging station D. For example, as shown in FIG. 5 the toned and the untoned parts of the image area, reach a voltage level 80 of about −700 volts. The first recharging device 36 is preferably a DC scorotron.

Figure 6:
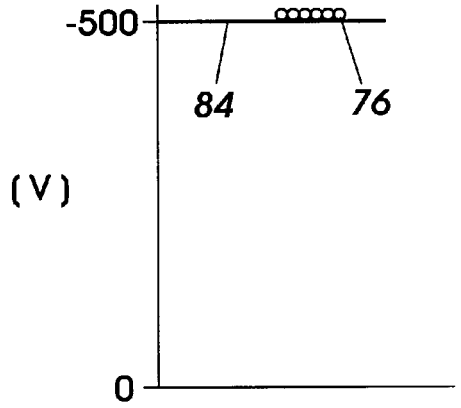
FIG. 6 shows a typical voltage profile of the image area after being recharged by a second recharging device.

After being recharged by the first recharging device 36, the image area passes to the second recharging device 37. Referring now to FIG. 6, the second recharging device 37 reduces the voltage of the image area, both the untoned parts and the toned parts (represented by toner 76) to a level 84 which is the desired potential of −500 volts.

Figure 7:
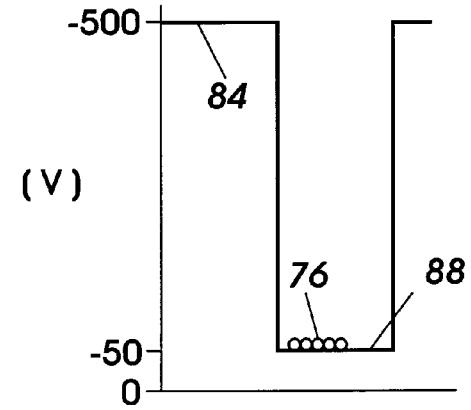
FIG. 7 shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 7 illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, reduces the potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 53 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 57 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 57. This causes the negatively charged toner powder images to move onto the support sheet 57. The transfer station J also includes a detack corona device 56 which facilitates the removal of the support sheet 52 from the printing machine 8.

After transfer, the support sheet 57 moves onto a conveyor (not shown) which advances that sheet to a fusing station K. The fusing station K includes a fuser assembly, indicated generally by the reference numeral 60, which permanently affixes the transferred powder image to the support sheet 57. Preferably, the fuser assembly 60 includes a heated fuser roller 67 and a backup or pressure roller 64. When the support sheet 57 passes between the fuser roller 67 and the backup roller 64 the toner powder is permanently affixed to the sheet support 57. After fusing, a chute, not shown, guides the support sheets 57 to a catch tray, also not shown, for removal by an operator.

After the support sheet 57 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Referring now to FIG. 8 in greater detail development system 34 includes a donor roll 42. A development apparatus, advances developer materials into development zones. The development system 34 is scavengeless. By scavengeless is meant that the developer or toner of system 34 must not interact with an image already formed on the image receiver. Thus, the system 34 is also known as non-interactive development systems. The development system 34 comprises a donor structure in the form of a roller 42. The donor structure 42 conveys a toner layer to the development zone 300 (i.e. area between the member 10 and the donor structure 42.

The toner layers can be formed on the donor 42 by either a two component developer (i.e. toner and carrier) or a single component developer of toner deposited on member 42 via a combination single component toner metering and charging device 310. The development zone contains an AC biased electrode structure 90 self-spaced from the donor roll 42 by the toner layer. The single component toner may comprise positively or negatively charged toner. The donor roller 42 may be coated with TEFLON-S (trademark of E. I. DuPont De Nemours) loaded with carbon black.

As the donor 42 rotates in the direction of arrow 68, the layer of triboelectric charged toner on its surface is brought under corona charging device 400 where the toner is charged to an average Q/M ratio of from −30 to −50 microCoulombs/gram. Corona device 400 may be in the form of an AC or DC charging device (e.g. scorotron). Agitation means 420 agitates the toner layer as it is charged resulting in a more uniform charge distribution, for non magnetic toners an ultrasonic probe can be used to agitate the toner layer. For magnetic toners an electromagnetic device can be employed. As donor 42 is rotated further in the direction indicated by arrow 68, the now charged toner layer is moved into development zone 300, defined by the gap between donor 42 and the surface of the photoreceptor belt 10. Toner is released from the surface of the donor 42, forming a toner cloud 112, and imagewise develops the electrostatic latent image 14 on photoreceptor 10.

Another method to increase charge uniformity would be to use an agitation brush or bar under the corotron to again cause more surfaces of the toner to be exposed to the corona stream. The brush or bar could be insulative or conductive. A further enhancement would be to use a conductive brush or bar and bias them. As another embodiment, the corotron could be eliminated and the bias on the brush or bar could be used to impart charge to the toner. Another refinement would be to use an insulative brush alone or to coat the brush or bar with a polymer that has charging properties with the toner. The conductive brush and bar could also be polymer coated. This too would enhance charge. Another possibility would be to use a magnetic brush with a high tribo insulating carrier on its surface and biased to the same polarity as the toner charge to enhance charge on the donor roll. It would be put in the same position as the brush. These same ideas could be used on the magnetic roll as well. That is, the charge could be imparted before the toner is transferred to the donor roll.

The electrode structure 90 is comprised of one or more thin (i.e. 50 to 100 mu(micron) diameter) tungsten or stainless steel wires which are lightly positioned against the toner on the donor structure 42. The electrode structure 90 has one set of electrode wires 92 and the other set of electrode wires 94. The distance between the wires and the donor is self-spaced by the thickness of the toner layer which is approximately 25 mu(micron). The extremities of the wires are supported by end blocks (not shown) at points slightly below a tangent to the donor roll surface. Mounting the wires in such manner makes the self-spacing insensitive to roll runout. A suitable scavengeless development system for incorporation in the present invention is disclosed in U.S. Pat. No. 4,868,600 incorporated herein by reference. As disclosed in the '600 patent a scavengeless development system may be conditioned to selectively develop one or the other of the two image areas (i.e. discharged and charged image areas) of the images by the application of appropriate AC and DC voltage biases to the wires 92 and 94 and the donor roll structure 42.

An AC power source 104 applies an electrical bias of, for example, 1,200 volts peak at 4 kHz between one set of electrode wires 92 and the other set of electrode wires 94. The electrode wires 94 extend to one end of the donor roll which is attached to the AC voltage 104. The electrode wires 92 are all connected together at the opposite end of the donor roll and attached to the DC supply 108. A DC bias from 0 to 1,000 volts is applied by a DC power source 108 to all of the electrode wires of both sets of electrode wires 92 and 94. The AC voltage applied between the set of electrode wires establishes AC fringe fields serving to liberate toner particles from the surface of the donor structure 42 to form the toner cloud 112 in the development zone 300.

When the AC fringe field is applied to a toner layer via an electrode structure in close proximity to the toner layer, the time-dependent electrostatic force acting on the charged toner momentarily breaks the adhesive bond to cause toner detachment and the formation of a powder cloud or aerosol layer 112. The DC electric field from the electrostatic image controls the deposition of toner on the image receiver.

Magnetic brush 310 loads donor roll with, for example, a two component developer, as illustrated in patent application U.S. Pat. No. 5,032,872 and U.S. Pat. No. 5,034,775, the disclosures of which are totally incorporated herein by reference. Also, U.S. Pat. No. 4,809,034 describes two-component loading of donor rolls and U.S. Pat. No. 4,876,575 discloses another combination metering and charging device suitable for use in the present invention. Toner can also be deposited on the donor roll 42 via a combination metering and charging devices. A combination metering and charging device may comprise any suitable device for depositing a monolayer of well charged toner onto the donor structure 42. For example, it may comprise an apparatus, such as described in U.S. Pat. No. 4,459,009, wherein the contact between weakly charged particles and a triboelectrically active coating contained on a charging roller results in well charged toner.

With continued reference to FIG. 8, augers, indicated generally by the reference numeral 98, are located in chamber 76 of housing 44. Augers 98 are mounted rotatably in chamber 76 to mix and transport developer material. The augers have blades extending spirally outwardly from a shaft. The blades are designed to advance the developer material in the axial direction substantially parallel to the longitudinal axis of the shaft. Toner metering roll is designated 98.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The augers in the chamber of the housing mix the fresh toner particles with the remaining developer material so that the resultant developer material therein is substantially uniform with the concentration of toner particles being optimized. In this manner, a substantially constant amount of toner particles are in the chamber of the developer housing with the toner particles having a constant charge.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on a surface, comprising:

a housing defining a chamber storing a supply of developer material comprising toner;

a toner donor member spaced from the surface and being adapted to transport toner to a region opposed from the surface;

means for conveying said developer material in the chamber of said housing onto a region of said donor member;

means for ion charging said toner loaded on the region of said donor member;

means for agitating toner in said region being charged by said ion charging means; and an electrode member near the surface of said donor member, said electrode member being electrically biased by a power supply to detach toner from said donor member to form a toner cloud for developing the latent image.

2. The apparatus according to claim 1, wherein said toner is charged to an average Q/M ratio of from −30 to −50 microCoulombs/gram.

3. The apparatus according to claim 1, wherein said ion charging means is an AC or DC charging device.

4. A method for enhancing toner charge level in a hybrid scavengeless development system for developing an latent image, comprising the steps of:

conveying said toner onto a region of a donor member;

ion charging said toner loaded on the region of said donor member;

agitating toner in said region being ion charged; and detaching toner from said donor member as to form a toner cloud for developing the latent image.

* * * * *